United States Patent [19]

Komatsubara et al.

[11] Patent Number: 4,808,247

[45] Date of Patent: Feb. 28, 1989

[54] PRODUCTION PROCESS FOR ALUMINUM-ALLOY ROLLED SHEET

[75] Inventors: Toshio Komatsubara; Mamoru Matsuo, both of Fukaya, Japan

[73] Assignee: Sky Aluminium Co., Ltd., Tokyo, Japan

[21] Appl. No.: 16,821

[22] Filed: Feb. 20, 1987

[30] Foreign Application Priority Data

| | | | |
|---|---|---|---|
| Feb. 21, 1986 | [JP] | Japan | 61-36761 |
| May 26, 1986 | [JP] | Japan | 61-120573 |
| Nov. 17, 1986 | [JP] | Japan | 61-273638 |

[51] Int. Cl.[4] ..... C22F 1/04

[52] U.S. Cl. ..... 148/2; 148/12.7 A; 148/415; 148/417

[58] Field of Search ..... 148/2, 11.5 A, 12.7 A, 148/415–418, 437–440; 420/534, 535, 544, 545, 546

[56] References Cited

U.S. PATENT DOCUMENTS

| | | | |
|---|---|---|---|
| 3,392,062 | 7/1968 | Altenpohl et al. | 148/11.5 A |
| 4,082,578 | 4/1978 | Evancho et al. | 148/12.7 A |
| 4,174,232 | 11/1979 | Lenz et al. | 148/2 |
| 4,589,932 | 5/1986 | Park | 148/12.7 A |

FOREIGN PATENT DOCUMENTS

| | | |
|---|---|---|
| 52-141409 | 11/1977 | Japan . |
| 53-103914 | 9/1978 | Japan . |
| 57-98648 | 6/1982 | Japan . |
| 59-39499 | 9/1984 | Japan . |
| 61-15148 | 4/1986 | Japan . |
| 61-201748 | 9/1986 | Japan . |
| 61-201749 | 9/1986 | Japan . |
| 62-4147 | 7/1981 | Switzerland . |

*Primary Examiner*—R. Dean

*Attorney, Agent, or Firm*—Armstrong, Nikaido, Marmelstein & Kubovcik

[57] ABSTRACT

An aluminum-alloy rolled sheet particularly suitable for use for an automotive body contains from 0.4 to 2.5% of Si, and Mg and Cu in an amount depending upon the Si content as follows:

(a) in the case of $0.4 \leqq Si \leqq 1.0\%$, $0.1 \leqq Mg < 0.4\%$, and $0.3 < Cu \leqq 1.5\%$;

(b) in the case of $1.0 < Si \leqq 1.8\%$, $0.1 \leqq Mg < 0.25\%$ and $0.3\% < Cu \leqq 1.5\%$; and, (c) in the case of $1.8 < Si \leqq 2.5\%$, $0.1 \leqq Mg < 0.25\%$ and $Cu \leqq 1.5\%$, and further contains from 0.05 to 0.4% Fe, the balance being aluminum and unavoidable impurities.

The sheet has an improved formability and a yield strength of 15 kg/mm$^2$ or more can be obtained after paint baking.

21 Claims, 2 Drawing Sheets

PRODUCTION PROCESS FOR ALUMINUM-ALLOY ROLLED SHEET

BACKGROUND OF THE INVENTION

1. Field of the Invention

The present invention relates to an aluminum-alloy rolled sheet for forming and a production process therefor. More particularly, the present invention relates to an aluminum-alloy rolled sheet for forming, which is suitable for applications in which a high strength is required and which has been subjected to paint baking, such as in an application for an automobile body, as well as to a process for producing the same.

2. Description of the Related Arts

In many cases, cold-rolled steel sheets are used for an automobile body, but because of recent demands for a lowering of the weight of the automobile body, consideration is being made of the use of an aluminum-alloy rolled sheet for that purpose. Since the sheet for an automobile body is formed by pressing, the requirements therefor include an excellent formability, particularly in stretching and bulging, non-generation of Leuders' lines during the forming operation, and a high strength, particularly after the sheet is subjected to paint baking.

Various aluminum-alloy sheets have been used for formed products, and the main alloys are classified by their alloying component series as follows;

A. A non-heat treatable type Al-Mg alloy, such as 5052 alloy in the O temper (2.2~2.8% Mg, 0.15~0.35% Cr, the being balance Al and unavoidable impurities) or 5182 alloy in the O temper (0.20~0.50% Mn, 4.0~5.0% Mg, the balance being Al and unavoidable impurities).

B. A heat treatable Al-Cu series alloy such as a 2036 alloy in T4 temper (2.2~3.0% Cu, 0.1~0.4% Mn, 0.3~0.6% Mg, and the balance being Al and unavoidable impurities).

C. A heat treatable Al-Mg-Zn-Cu series alloy in T4 temper. Note, the alloys of these series are disclosed in Japanese Unexamined Patent Publication Nos. 52-141,409, 53-103,914, and 57-98,648.

D. A heat treatable Al-Mg-Si series alloy, e.g., 6009 alloy in T4 temper (0.4~0.8% Mg, 0.6~1.0% Si, 0.15~0.6% Cu, 0.2~0.8% Mn, the balance being Al and unavoidable impurities) in T4 temper or 6010 alloy (0.6~1.0% of Mg, 0.8~1.2% Si, 0.15~0.60% Cu, 0.2~0.8% Mn, the balance being Al and unavoidable impurities).

Nevertheless, it is difficult to completely satisfy all of the above described requirements by the above mentioned conventional aluminum alloys.

That is, the strength of the alloy "A" is not satisfactory, in that wrought products of this alloy have problems wherein Leuders' marks are liable to occur during the forming process and, further, that the strength is lowered during the paint baking process.

The alloy "B" has the problems of a poor formability and a strength reduction during the paint baking process. The alloy "C" does not have a satisfactory formability, particularly a bending property. This alloy also has the problem of a strength reduction during the paint baking process. The alloys "D" have an unsatisfactory strength for the 6009 alloy and unsatisfactory stretching and bending characteristics for the 6010 alloy.

As described above, with the conventional aluminum alloys, it is difficult to completely satisfy the requirements for a sheet to be used for an automobile body, i.e., an excellent formability, particularly the stretching and bulging formability, no generation of Leuders' marks, and a high strength, particularly the strength after paint baking. To solve these problems, in Japanese Unexamined Patent Publication Nos. 61-201748 and 61-201749 the present inventors proposed an aluminum-alloy rolled sheet for forming having an improved balance in strength and formability and generating no Leuders' marks, as well as a production method for the same.

The present inventors carried out further studies of an aluminum-alloy sheet for forming, and arrived at the following conclusions. The rigidity of an automobile body is virtually controlled by the modulus of elasticity of the used material. Therefore, when an aluminum-alloy material having a lower modulus of elasticity than that of a cold-rolled steel sheet is used, a limitation arises in that the sheet thickness cannot be reduced, even if the material's strength has been enhanced. Under these circumstances, provided that a yield strength of 15 kg/mm$^2$ or more is ensured after the paint baking, a further enhancement of strength is less advantageous than a further enhancement of formability, when applying an aluminum-alloy sheet to forming an intricate design of an automobile body. In other words, even if the strength as in the above two patent applications can be ensured only to a certain level, an intricate design of automobile body can be met by a further enhancement of the formability rather than the strength. The fields in which an aluminum-alloy sheet can be applied are thus broadened. Evidently, also in this case, Leuders' marks must not be generated during the forming.

SUMMARY OF THE INVENTION

It is therefore an object of the present invention to provide an aluminum-alloy rolled sheet, which has considerably improved forming characteristics, particularly in bulging, bending, and stretching, and a yield strength of 15 kg/mm$^2$ or more after forming and paint baking, and exhibits no generation of Leuders' marks during the forming process.

It is another object of the present invention to provide a process for producing an aluminum-alloy rolled sheet having the properties as described above.

In accordance with the object of the present invention, there is provided an aluminum-alloy rolled sheet for forming, which contains, by weight % from 0.4 to 2.5% of Si, and Mg and Cu in an amount depending upon the Si content as follows:

(a) in the case of $0.4\% \leqq Si \leqq 1.0\%$, $0.1\% \leqq Mg < 0.4\%$, and $0.3 < Cu \leqq 1.5\%$;

(b) in the case of $1.0\% < Si \leqq 1.8\%$, $0.1\% \leqq Mg < 0.25\%$ and $0.3\% < Cu \leqq 1.5\%$; and, (c) in the case of $1.8\% < Si \leqq 2.5\%$, $0.1\% \leqq Mg < 0.25\%$ and $0\% \leqq Cu \leqq 1.5\%$, and which further contains from 0.05 to 0.4% Fe, the balance being aluminum and unavoidable impurities. This alloy is hereinafter referred to as the Al-Mg-Si-(Cu) alloy.

Another aluminum-alloy rolled sheet according to the present invention contains, in addition to the components of Al-Mg-Si-(Cu) alloy, at least one member selected from the group consisting of from 0.05 to 0.6% of Mn, from 0.05 to 0.3% of Cr, and from 0.05 to 0.15% of Zr.

In accordance with the present invention, there is provided a method for producing an aluminum-alloy sheet for forming comprising the steps of:

casting an alloy ingot having the composition of the above mentioned Al-Mg-Si-(Cu) alloy or containing occasionally Mn, Cr, and/or Zr, by a continuous casting or semicontinuous DC (direct chill) casting;

homogenizing the alloy ingot at a temperature of from 450° to 580° C. for a period of from 1 to 48 hours;

subsequently, rolling until a requisite sheet thickness is obtained;

holding the sheet at a temperature of from 500° to 580° C. for a period of at least 5 seconds, followed by quenching; and, aging at room temperature.

DESCRIPTION OF THE PREFERRED EMBODIMENTS

The present invention is hereinafter described in detail.

First the composition of the aluminum alloy according to the present invention is described.

The strengthening by Si due to precipitation hardening of $Mg_2Si$ formed under the copresence of Mg is effective. In addition to the effective strengthening, Si also effectively enhances the formability, particularly the stretching formability. When the Si content is less than 0.4%, the strength is unsatisfactory. On the other hand, when the Si content exceeds 2.5%, the strengthening effects of Si-addition no longer increase, and the formability is reduced. The Si content is therefore set to be from 0.4 to 2.5%.

As is described above, Mg is a strengthening element by forming $Mg_2Si$ under the copresence of Si. This effect is not attained at an Mg content of less than 0.1%. Mg is effective for enhancing the strength but reduces the formability at excess content. This content is dependent upon the Si content. Namely, when the Si content is from 0.4% to 1%, the formability is reduced by an Mg content of 0.4% or more, and when the Si content is from more than 1% to 2.5%, the formability is reduced by an Mg content of 0.25% or more.

Cu is an element which enhances the strength without impairing the formability. The Cu content is therefore dependent upon the Mg and Si contents. In the composition having the content, $0.4\% \leqq Si \leqq 1.0\%$ and $0.1\% \leqq Mg < 0.4\%$ or $1.0\% < Si \leqq 1.8\%$ and $0.1\% \leqq Mg \leqq 0.25\%$, it is difficult to attain sufficient strength while maintaining the formability only by the Mg and Si contents. The Cu is therefore indispensable. The enhancement of strength is unsatisfactory at a Cu content of 0.3% or less, and the strength is too high to maintain the formability at a Cu content of more than 1.5%. In the composition having the contents, $1.8\% < Si \leqq 2.5\%$, and $0.1\% \leqq Mg \leqq 0.25\%$, the strength can be attained without an intentional addition of Cu. The Cu addition is effective for stably ensuring the strength and formability, but the strength is lowered at a Cu content exceeding 1.5%.

Fe refines the recrystallized grains and contributes to an enhancement of the strength by means of grain refinement. The recrystallized grains coarsen at an Fe content of less than 0.05%, and the formability is reduced at an Fe content exceeding 0.4%. The Fe content is therefore set to be from 0.05 to 0.4%.

Mn, Cr, and Zr refine the recrystallized grains, stabilize the structure, and enhance the formability, at contents of less than 0.05% of Mn, less than 0.05% of Cr, and less than 0.05% of Zr. On the other hand, when the Mn exceeds 0.6%, the formability is reduced, and when the Cr and Zr exceed 0.3% and 0.15%, respectively, large intermetallic compounds are formed. Accordingly, the following ranges of these contents are set: 0.05~0.6% of Mn, 0.05~0.3% of Cr, and 0.05~0.15% of Zr.

In the ordinary aluminum alloys, a trace amount of Ti or Ti and B is occasionally added to refine the crystal grains of an ingot, and in the aluminum-alloy rolled sheet according to the present invention, a trace amount of Ti or Ti and B also may be added. However, when the Ti content is less than 0.01%, the effect thereof is not realized. On the other hand, when the Ti content exceeds 0.15%, primary $TiAl_3$ crystallizes to reduce the formability. The Ti content is therefore preferably in the range of from 0.01 to 0.15%. When B is added together with Ti, the effect of B is not realized at a content of less than 1 ppm. On the other hand, when the B content exceeds 500 ppm, coarse particles of $TiB_2$ are mixed and reduce the formability. The B content is therefore preferably in the range of from 1 to 500 ppm.

The process for producing an aluminum-alloy sheet according to the present invention is now explained.

The aluminum-alloy ingot having one of the above compositions is formed by an ordinary continuous casting or a semicontinuous DC casting method.

The aluminum-alloy ingot is subjected to homogenizing, to improve the homogeneity and to refine the recrystallized grains of final product. The effects of homogenizing are not properly attained when the heating temperature is less than 450° C. On the other hand, when the heating temperature exceeds 580° C., the eutectic melting may occur. When the heating time is less than 1 hour, the effects of homogenizing are not realized. On the other hand, a long time homogenizing exceeding 48 hours does not enhance the homogenizing effects but merely increases the cost. Note, the heating prior to hot-rolling may be carried out during the homogenizing process.

After the homogenizing, the ingot is rolled by an ordinary method to a requisite thickness. The rolling may be exclusively hot-rolling, or may be a combined hot-rolling and subsequent cold-rolling.

Here, solution heat treatment temperature of the alloy series in this invention ranges from 500° C. to 580° C. Therefore at least 450° C. as a starting temperature of hot rolling is needed to satisfy the above mentioned limitation. Preferably, in the case of heat treating in a box furnace, the soaking and hot-rolling are carried out such that the starting temperature of hot-rolling is 90% or higher than the temperature of the solution heat treatment, to be selected in a process, and the finishing temperature of the hot-rolling is 350° C. or less. This starting temperature is necessary in the case of heat treating in a continuous furnace.

The rolled sheet is subjected to the solution heat treatment at a temperature of from 500° to 580° C., followed by rapid cooling (quenching). When the solution heat treatment temperature is less than 500° C., the solution effect is unsatisfactory and a satisfactory strength is not obtained. On the other hand, when the solution treatment is more than 580° C., the eutectic melting may occur. A holding of at least 5 seconds is necessary for completing the solutioning. A holding of 30 seconds or longer is preferred. The rapid cooling after the holding at a solution temperature may be such that the cooling speed is at least equal to the forced air cooling, specifically 300° C./min or higher. As far as the cooling speed is concerned, water quenching is most preferable, forced air cooling however, gives quenching without distortion. The solution heat treatment is preferably carried out in a continuous solution heat treatment furnace and under the following conditions: heating at a speed of 5° C./sec or more; holding for 5~180 seconds or less, and cooling at a speed of 300° C./min or more. The heating at a speed of 5° C./sec or more is advantageous for refining the recrystallized grains.

A continuous solution heat treatment furnace is most appropriate for subjecting the sheets, which are mass produced in the form of a coil, to the solution heat treatment and rapid cooling. The holding time of 180 seconds or less is necessary for attaining a high productivity. The slower cooling speed is more advisable for providing a better flatness and smaller sheet distortion. The higher cooling speed is more advisable for providing a higher strength. To attain a good flatness and no distortion, a forced air cooling at a cooling speed of 5° C./sec to 300° C./sec is preferable.

Also, between the hot-rolling and solution heat treatment, preferably an intermediate annealing is carried out. The holding temperature is preferably from 300° to 450° C., more preferably from 300° to 350° C., and the holding time is preferably from 0.5 to 10 hours for the intermediate annealing. The intermediate annealed sheet of aluminum alloy is preferably cold-rolled at a reduction rate of at least 30%, and is then solution-heat treated.

When the temperature of the intermediate annealing is less than 300° C., the recrystallization becomes incomplete, and grain growth and discoloration of the sheet surface occur when the temperature of intermediate annealing is higher than 450° C. When the intermediate annealing time is less than 0.5 hours, a homogeneous annealing of coils in a large amount becomes difficult in the box annealing furnace. On the other hand, an intermediate annealing of longer than 10 hours makes the process not economically significant. When the solution heat treatment is carried out in a continuous solution heat treatment furnace, the intermediate annealing temperature is preferably from 300° to 350° C. At an intermediate annealing temperature higher than 350° C., the $Mg_2Si$ phase coarsens and the solutioning is completed within 180 seconds only with difficulty. A cold-rolling at a reduction of at least 30% must be interposed between the intermediate annealing and solution heat treatment to prevent the grain growth during the solution heat treatment.

The solution heat treated sheet, is preferably subjected to straightening, e.g., by skin-passing, stretching, and levelling for flattening the distortion generated in the quenched sheet, since such a distortion may make it inappropriate as the final product. Any of the methods for flattening the distortion impart some cold-forming to the sheet so as to flatten the distortion. The degree of cold-forming depends upon the degree of distortion generated by the quenching after solution heat treatment, but it is usually in a degree such that the yield strength is enhanced by 1 $kg/mm^2$ or more and the formability is reduced by 0.2 mm or more, in terms of Erichsen value. The flattening process leads to a decrease in the formability, and thus a heat treatment for recovering the formability is carried out according to a preferred embodiment of the present invention. Note, the alloys according to the present invention are heat treatable aluminum alloy, so that the conditions for recovering the formability should be selected so as to avoid age hardening, which enhances the strength and reduces the formability. Such conditions are explained with reference to the drawings.

DESCRIPTION OF THE PREFERRED EMBODIMENTS

The rolled sheet, which has been subjected to flattening (process) and exhibits a reduced formability, is subjected to the final heat treatment in which the sheet is heated to a temperature of from 60° to 360° C., held at this temperature, then cooled, or heated to the above temperature followed by immediate cooling.

Figure 1:
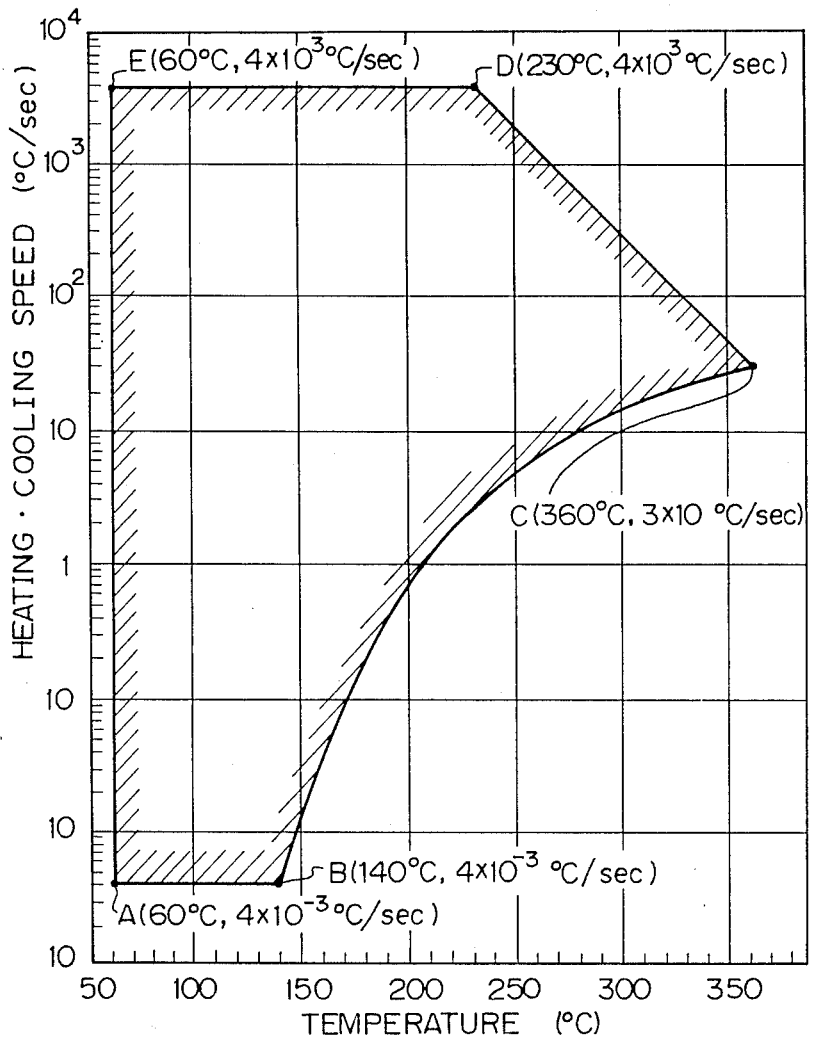
FIG. 1 is a graph showing appropriate ranges of heating and cooling speeds in connection with the temperature of a final heat treatment.

Referring to FIG. 1, the hatched region is defined by the straight lines or curve connecting the points A, B, C, D, and E and is the region surrounded thereby. The heating temperature is given on the abscissa, and the heating speed (on the ordinate) is determined such that the crossing point of the ordinate and abscissa values falls within the hatched region.

Figure 2:
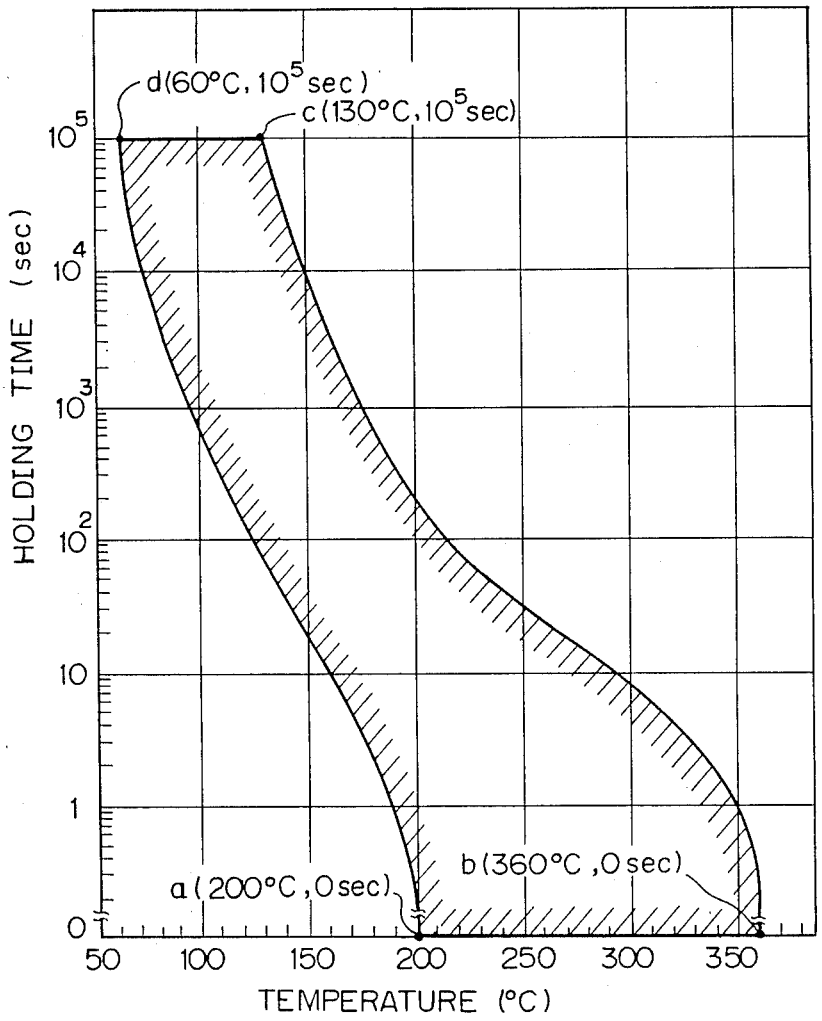
FIG. 2 is a graph showing the appropriate range of the holding time and temperature.

Referring to FIG. 2, the hatched region is defined by the straight lines or curve connecting the points a, b, c, and d and is the region surrounded thereby. The heating temperature is given on the abscissa, and the holding time (on the ordinate) is determined such that the crossing point of the ordinate and abscissa values falls within the hatched region.

The cooling speed is determined within the hatched region of FIG. 1.

The points A through E in FIG. 1 indicate the following temperatures and heating or cooling speeds.

A: 60° C., $4\times10^{-3}$° C./sec
B: 140° C., $4\times10^{-3}$° C./sec
C: 360° C., $3\times10$° C./sec
D: 230° C., $4\times10^{3}$° C./sec
D: 60° C., $4\times10^{3}$° C./sec The points a through e in FIG. 2 indicate the following temperature and holding time.

a: 200° C., 0 sec
b: 360° C., 0 sec
c: 130° C., $10^5$ sec
d: 60° C., $10^5$ sec The grounds for determining the hatched region as in FIG. 1 for the heating speed are now described.

Under the line AB, there are no problems in the material's properties, but the productivity is too low because of the slow heating, and the excessively long time required for temperature-elevation.

Under the curve BC, the heating speed is so slow that precipitation hardening is caused during the temperature elevation. That is, the strength is enhanced but the formability is reduced.

Above the line DC, the heating is so rapid that distortion is generated during the temperature elevation. In this case, the effects of flattening are lost.

Above the line DE, the heating speed substantially exceeds that attained by immersion in an oil bath and is impractically rapid.

Left of the line EA, i.e., at a heating temperature of less than 60° C., the working strain generated due to flattening treatment cannot be relieved regardless of the temperature.

The holding temperature- and time-region illustrated in FIG. 2 is now described. Regarding the line a–b, the holding temperature is from 200° to 360° C. When the holding temperature is from 200° to 360° C., the work strain can be relieved even by initiating the cooling immediately after attaining the holding temperature, i.e., by a zero seconds holding time. The minimum holding time is therefore zero seconds of line ab.

In the temperature- and holding time-region at the right of curve cb, the work strain can be relieved but the strength is enhanced due to the aging at high temperature, and hence the formability is reduced. In a particularly high temperature region, overaging occurs so that the formability is reduced, and in addition, the requisite strength cannot be obtained after the paint baking or by a T6 treatment.

Above the line cd, the work strain can be relieved to restore the formability, but the holding time exceeding 24 hours makes the process economically insignificant.

In the region at the left of the curve da, the heat necessary for relieving the work strain cannot be imparted to appreciably restore the formability.

The cooling speed must be within the hatched region surrounded by A, B, C, D and E in FIG. 1.

In the region under the line AB, there are no problems in the material's properties problems, but an exceedingly long cooling time is necessary because of slow cooling under the line AB.

In the region below curve BC, where the cooling speed is slow, the aging and precipitation occur during the cooling, so that the formability is reduced, and hence the requisite strength cannot be obtained after the paint baking and by a T6 treatment.

When the cooling speed exceeds the line DC, the cooling speed is so high that the material is distorted, and hence the flattening treatment effects are lost.

In the region above the straight line DE, the cooling speed essentially exceeds that of water cooling. Such drastic rapid cooling is impractical.

In the region at the left of the straight line EA, the work strain cannot be relieved regardless of the cooling speed.

As described above, the cooling speed is dependent upon the heating temperature, as is the heating speed. The cooling speed falls within the range surrounded by A, B, C, D, and E.

When the final heat-treatment is carried out after the flattening step, the work strain induced in this step is relieved to restore the formability, particularly the bulging-formability, and an excellent formability, particularly bulging-formability attained in a T4 tempering after the solution heat treatment any quenching, can be reverted. In addition, since neither artificial age hardening nor overaging occur in the final heat treatment, the formability is not reduced and the requisite strength can be obtained by paint baking or T6 treatment after forming operation. Furthermore, heating and cooling rate are adjusted so that the distortion is not induced and, therefore, the flatness improved by the preceding straightening step can be maintained.

The aluminum-alloy sheet, which has been solution-heat treated and then occasionally straightened preferably with a final heat-treatment, is aged at a room temperature by a known method.

The aluminum alloy rolled sheet is ordinarily subjected to forming, such as press forming, when applied for practical use. Since the aluminum alloy rolled sheet according to the present invention has an improved formability and exhibits no generation of Leuders' marks, there is little possibility of generating defective individuals, and thus the recovery and productivity are high. When the straightened sheet is formed, the recovery and productivity are further increased, because of an improved flatness.

After the forming, the painting and baking, or T6 treatment may be carried out. The baking temperature is ordinarily from approximately 150° to 250° C.

The present invention is now explained in metallurgical terms.

Since the alloys of present invention are heat treatable, in which the strength is enhanced by forming GP zones, and fine precipitates of $\beta''$ and $\beta'$ which consists of Mg-Si, the solution heat treatment and subsequent quenching are indispensable. Since the solution heat treatment is the step in which the precipitated phases, e.g. $Mg_2Si$, formed in the preceeding steps are caused to dissolve into the matrix, the time required for the complete solutioning depends on amount and size of precipitates before solution heat treatment. Therefore, it is important that precipitated $Mg_2Si$ are small in amount or in size in case that the solution heat treatment is carried out by using the continuous solution heat treatment furnace, because rapid solutioning is necessary from an economical stand point. To realize this, the starting temperature of the hot-rolling is at least 90% of the solution-heat treatment temperature in the case of using a continuous solution heat treatment furnace. This is not necessary but is preferred in the case of using a box furnace. When the former temperature is less than 90% of the solution heat treatment temperature, coarse precipitation of $Mg_2Si$ phases occurs, with the consequence that a long time is needed to obtain a satisfactory solutioning. The finishing temperature of the hot-rolling is also important, since the coil, which is usually the product of hot-rolling, exhibits slow cooling speed such that there is a tendency for the $Mg_2Si$ to precipitate. When the finishing temperature of the hot-rolling is 350° C. or more, the precipitation of coarse $Mg_2Si$ is liable to occur, thereby degrading the solutioning characteristics. The heat cycle as described above leads to the consequence whereby, between the start and finish of the hot-rolling, the alloy undergoes a temperature region between 90% or less of the solution-heat treatment temperature and 350° C. or more, at which the coarse precipitation is liable to occur. Nevertheless, since the ordinary hot-rolling process is completed within 10 minutes, or within 20 minutes at the longest, a coarse precipitation of $Mg_2Si$ that will impede the solutioning characteristics is unlikely to occur.

If the coarse recrystallized grain occur during the hot-rolling, the effect will remain even in the final sheet and the patterns referred to as flow lines will appear in the formed articles. The intermediate annealing for additional recrystallizing, between the hot-rolling and solution treatment is highly effective for removing these defects.

The aluminum-alloy rolled sheets according to the present invention are advantageous not only for their mechanical properties and formability but also for the reclamation of scrap, since it contains merely Mg, Si, and Cu which are most broadly used elements in the ordinary, rolled sheet, extruded products, castings, and the like. The scraps of the aluminum-alloy rolled sheet according to the present invention can be used for producing the other alloys, and the scraps of the other alloys can be used for producing the aluminum-alloy rolled sheet according to the present invention.

The final heat treatment according to a preferred embodiment, which can revert the formability reduced by stretching or the like to that before this reduction, also can be applied generally to 6000 series alloy, specifically the Al-Mg-Si alloy containing from 0.1 to 1.2% of Mg and from 0.4 to 2.5% of Si.

The aluminum-alloy rolled sheet according to the present invention is most appropriate for application for the body of an automobile body, and can also exhibit excellent characteristics when used for automobile parts, such as a wheel, an oil filter, an air cleaner and the like, various caps, blinds, aluminum cans, kitchen containers, instrument covers, and the chassis of an electrical appliance.

The present invention is hereinafter explained with reference to examples.

EXAMPLE 1

The inventive alloy Nos. 1 through 6 and the comparative alloy Nos. 7 through 15 having the composition as shown in Table 1, was melted by an ordinary method and cast by a DC method to obtain ingots. The ingots were then homogenized as shown in Table 2. Then, after a hot-rolling to a thickness of 4 mm, a cold-rolling to a thickness of 1.0 mm was carried out. The solution heat treatment or annealing as shown in the final heat treatment column in Table 2 was then carried out. Subsequently, the natural aging was carried out by standing at room temperature for two weeks. The mechanical properties and formability were investigated on $T_4$ temper which is natural aging of two weeks. The results are shown in Table 3.

In order to investigate the change in strength of the deformed sheets after paint baking, several sheets were subjected to a cold-working by 5% and 10%, which corresponded to forming. The non cold-worked (0% working) and cold-worked sheets (at 5% and 10%) were subjected to heat treatment at 200° C. for 1 hour, which corresponded to paint baking. The strengths at the respective steps were investigated, and the results are shown in Table 4.

TABLE 1

| Designation | Alloy No. | Chemical Composition of Alloys (wt %) Si | Mg | Cu | Mn | Cr | Zr | Ti | B | Fe | Remarks |
|---|---|---|---|---|---|---|---|---|---|---|---|
| Inventive Alloys | 1 | 1.82 | 0.23 | Tr | Tr | Tr | Tr | 0.02 | 0.0003 | 0.17 | |
| | 2 | 2.06 | 0.22 | 0.71 | Tr | Tr | Tr | 0.02 | 0.0003 | 0.18 | |
| | 3 | 1.63 | 0.15 | 0.43 | 0.31 | Tr | Tr | 0.02 | 0.0005 | 0.21 | |
| | 4 | 1.31 | 0.27 | 0.51 | Tr | 0.18 | Tr | 0.02 | 0.0005 | 0.32 | |
| | 5 | 0.72 | 0.38 | 1.12 | Tr | Tr | 0.08 | 0.02 | 0.0003 | 0.12 | |
| | 6 | 0.51 | 0.13 | 0.92 | 0.11 | 0.10 | Tr | 0.02 | 0.0005 | 0.17 | |
| Comparative and Conventional Alloys | 7 | 1.41 | 0.43 | 0.82 | 0.12 | Tr | Tr | 0.02 | 0.0005 | 0.18 | |
| | 8 | 3.21 | 0.21 | 1.38 | Tr | 0.20 | Tr | 0.02 | 0.0005 | 0.20 | |
| | 9 | 0.32 | 0.52 | 0.35 | 0.12 | Tr | Tr | 0.02 | 0.0003 | 0.22 | |
| | 10 | 0.62 | 0.07 | 0.40 | 0.21 | Tr | Tr | 0.02 | 0.0003 | 0.16 | |
| | 11 | 1.30 | 0.21 | 0.51 | 0.31 | Tr | Tr | 0.02 | 0.0003 | 0.51 | |
| | 12 | 0.68 | 0.47 | 0.31 | 0.28 | Tr | Tr | 0.03 | 0.0003 | 0.25 | 6009 Alloy |
| | 13 | 0.86 | 0.85 | 0.29 | 0.24 | Tr | Tr | 0.02 | 0.0003 | 0.20 | 6010 Alloy |
| | 14 | 0.30 | 0.35 | 2.31 | 0.24 | Tr | Tr | 0.01 | 0.0003 | 0.20 | 2036 Alloy |
| | 15 | 0.09 | 4.53 | 0.03 | 0.35 | Tr | Tr | 0.02 | 0.0003 | 0.21 | 5182 Alloy |

TABLE 2

| Alloy No. | Heat Treating Conditions: Homogenizing | Final Heat Treatment |
|---|---|---|
| 1–14 | 530° C. × 10 hours | 530° C. × 1 hour-holding, then water quenching (solution treatment) |
| 15 | 470° C. × 10 hours | 350° C. × 2 hours holding, then slow cooling (annealing: O temper) |

TABLE 3

| Alloy No. | Mechanical Properties, Formability: 0.2% Yield Strength (kg/mm²) | Tensile Strength (kg/mm²) | Elongation (%) | Erichsen Value | Limiting Drawing Ratio | Bending Property (Minimum radius by 180° bending) (mm) | Comprehensive Evaluation of Formability | Leuders Mark |
|---|---|---|---|---|---|---|---|---|
| 1 | 10.9 | 21.4 | 32 | 10.1 | 2.19 | 0.2 | o | no |
| 2 | 13.5 | 24.2 | 32 | 9.9 | 2.20 | 0.3 | o | no |
| 3 | 10.3 | 20.6 | 32 | 10.2 | 2.21 | 0.2 | o | no |
| 4 | 13.7 | 24.8 | 31 | 9.8 | 2.17 | 0.4 | o | no |
| 5 | 14.2 | 27.1 | 31 | 9.7 | 2.18 | 0.4 | o | no |
| 6 | 11.2 | 22.1 | 32 | 10.0 | 2.28 | 0.2 | o | no |
| 7 | 15.1 | 28.1 | 29 | 9.4 | 2.21 | 0.6 | x | no |
| 8 | 16.2 | 29.1 | 28 | 8.9 | 2.21 | 1.0 | x | no |
| 9 | 13.8 | 22.5 | 28 | 8.9 | 2.17 | 0.8 | x | no |
| 10 | 9.2 | 20.1 | 32 | 10.2 | 2.17 | 0.4 | o | no |
| 11 | 13.2 | 25.4 | 29 | 9.1 | 2.18 | 1.0 | x | no |
| 12 | 13.6 | 24.3 | 26 | 9.3 | 2.18 | 0.5 | x | no |
| 13 | 16.6 | 31.3 | 26 | 8.7 | 2.21 | 1.0 | x | no |
| 14 | 18.6 | 33.3 | 24 | 8.5 | 2.11 | 1.2 | x | no |
| 15 | 14.5 | 29.8 | 28 | 9.5 | 2.19 | 0.5 | o | yes |

TABLE 4

Change in Strength due to Forming and Heating Treatment corresponding to Baking (kg/mm²)

| Alloy No. | Strength before Forming | | Strength after Cold Forming | | | | Strength after Heating to 200° C. for 1 Hour | |
|---|---|---|---|---|---|---|---|---|
| | | | after 5% forming | | after 10% forming | | 0% formed material | |
| | Tensile Strength | 0.2% Yield Strength | Tensile Strength | 0.2% Yield Strength | Tensile Strength | 0.2% Yield Strength | Tensile Strength | 0.2% Yield Strength |
| 1 | 21.4 | 10.9 | 23.2 | 16.2 | 24.1 | 20.1 | 22.7 | 16.0 |
| 2 | 24.2 | 13.5 | 24.8 | 19.2 | 25.3 | 22.5 | 25.7 | 17.1 |
| 3 | 20.6 | 10.3 | 21.6 | 16.1 | 22.1 | 19.8 | 21.3 | 15.8 |
| 4 | 24.8 | 13.7 | 26.0 | 19.3 | 26.8 | 23.1 | 26.3 | 17.7 |
| 5 | 27.1 | 14.2 | 28.6 | 21.1 | 30.2 | 24.1 | 28.1 | 18.6 |
| 6 | 22.1 | 11.2 | 24.1 | 16.3 | 25.8 | 18.2 | 24.7 | 15.9 |
| 7 | 28.1 | 15.1 | 30.8 | 22.1 | 32.2 | 26.3 | 30.1 | 21.2 |
| 8 | 29.1 | 16.2 | 30.2 | 19.8 | 30.7 | 22.7 | 29.8 | 17.8 |
| 9 | 27.5 | 13.8 | 24.1 | 16.8 | 25.1 | 18.3 | 24.1 | 14.1 |
| 10 | 20.1 | 9.2 | 23.1 | 11.1 | 24.0 | 12.5 | 22.5 | 11.3 |
| 11 | 25.4 | 13.2 | 26.3 | 16.8 | 27.0 | 20.1 | 25.4 | 16.1 |
| 12 | 24.3 | 13.6 | 26.0 | 18.0 | 27.1 | 21.2 | 28.1 | 16.2 |
| 13 | 31.3 | 16.0 | 32.0 | 22.8 | 33.2 | 26.2 | 33.2 | 22.8 |
| 14 | 33.3 | 18.6 | 35.0 | 28.2 | 36.8 | 33.5 | 31.0 | 18.0 |
| 15 | 29.8 | 14.5 | 30.1 | 20.9 | 32.2 | 27.0 | 29.7 | 14.6 |

| Alloy No. | Strength after Heating to 200° C. for 1 Hour | | | | Evaluation of Strength |
|---|---|---|---|---|---|
| | 5% formed material | | 10% formed material | | |
| | Tensile Strength | 0.2% Yield Strength | Tensile Strength | 0.2% Yield Strength | |
| 1 | 24.1 | 20.5 | 25.1 | 22.9 | o |
| 2 | 26.2 | 23.3 | 27.1 | 24.2 | o |
| 3 | 22.6 | 20.2 | 23.1 | 22.4 | o |
| 4 | 27.1 | 25.1 | 27.8 | 26.5 | o |
| 5 | 29.8 | 26.2 | 32.4 | 27.8 | o |
| 6 | 25.4 | 20.3 | 26.5 | 22.6 | o |
| 7 | 31.3 | 26.3 | 32.2 | 27.3 | o |
| 8 | 30.0 | 24.0 | 31.6 | 25.8 | o |
| 9 | 25.8 | 15.3 | 26.0 | 16.5 | x |
| 10 | 23.6 | 12.1 | 24.3 | 12.6 | x |
| 11 | 27.0 | 21.1 | 27.3 | 23.6 | o |
| 12 | 29.2 | 23.2 | 30.1 | 23.2 | o |
| 13 | 35.6 | 29.1 | 39.1 | 30.6 | o |
| 14 | 33.1 | 24.2 | 35.1 | 28.1 | o |
| 15 | 29.8 | 14.8 | 29.8 | 14.8 | o |

In Table 3, the comprehensive evaluation of formability was o, when the Erichsen value (Er) of 9.5 or more, bending (minimum radius of 180° bending) of 0.5 mm or less, and the elongation of 30% or more were achieved at the same time. The comprehensive evaluation of formability was x (failure), when any one of the formability factors did not satisfy the above requirements. In addition, in Table 4, the comprehensive evaluation of strength was x (failure), when the strength after the treatment corresponding to paint baking (the strength after the heat treatment of 200° C.×1 hour) was less than 15 kg/mm² of 0.2% yield strength. The comprehensive evaluation of strength was o (acceptable), when the strength after the treatment corresponding to paint baking (the strength after the heat treatment of 200° C.×1 hour) was 15 kg/mm² or more of 0.2% yield strength, respectively.

As is apparent from Table 3, in any of the inventive alloy Nos. 1 through 6, the bulging characteristic and bending characteristics are improved, and the Leuders' marks are not generated. An improvement in the formability is therefore apparent. As is apparent from Table 4 in the inventive alloys the strength is enhanced in the paint baking step after the forming, so that the paint-coated and baked forming products having a yield strength of 15 kg/mm² or more can be finally obtained.

EXAMPLE 2

The inventive alloy Nos 1 through 5 of Table 1 were subjected to the steps of DC casting, homogenizing, hot-rolling, and cold-rolling to obtain 1.0 mm thick cold-rolled sheets, as in Example 1 under the same conditions as in Example 1 except for the following. In the hot-rolling, the starting temperature was 530° C., and the finishing temperature at a sheet thickness of 4 mm was from 200° to 250° C. In addition, in the solution treatment a continuous solution heat treating furnace was used, the temperature was rapidly elevated at a heating speed of 1200° C./min, and the temperature was held at 540° C. for 60 seconds, followed by forced air cooling at a speed of 1200° C./min.

The formability and mechanical properties of the aluminum alloy sheets, which were naturally aged at room temperature for two weeks, are given in Table 5. It is apparent that good combination of formability and strength was achieved according to the present invention.

TABLE 5

| Alloy No. | 0.2% Yield Strength (kg/mm²) | Mechanical Properties, Formability (Example 2) Tensile Strength (kg/mm²) | Elongation (%) | Erichsen Value | Limiting Drawing Ratio | Bending Property (Minimum radius by 180° bending) (mm) | Leuders Mark |
|---|---|---|---|---|---|---|---|
| 1 | 10.8 | 21.3 | 32 | 9.9 | 2.18 | 0.3 | no |
| 2 | 13.4 | 24.2 | 31 | 9.8 | 2.21 | 0.4 | no |
| 3 | 10.8 | 20.7 | 31 | 10.1 | 2.19 | 0.3 | no |
| 4 | 13.8 | 24.9 | 31 | 9.8 | 2.18 | 0.4 | no |
| 5 | 14.0 | 27.0 | 31 | 9.7 | 2.20 | 0.4 | no |
| 6 | 11.5 | 22.2 | 32 | 9.9 | 2.21 | 0.3 | no |

EXAMPLE 3

The alloy No. 3 of Table 1 was subjected to the steps of: Dc casting; homogenizing at 530° C. for 10 hours; heating for hot-rolling at a temperature of 420° C. for 2 hours; hot-rolling (starting at 420° C., and finishing at 260° C.; thickness of 4 mm); cold-rolling to 1 mm (hot-rolled sheet without annealing was cold-rolled); solution-treatment and quenching (heating speed of 1200° C./min, holding at 500° C. for 180 secs, and cooling speed 1200° C./min); aging at room temperature for 7 days; cold working at a ratio of 0%, 5%, and 10% corresponding the practical forming; and, heating corresponding to paint baking at 200° C. for 1 hour.

The formability and mechanical properties of the aluminum alloy sheets, which were naturally aged, are given in Table 6.

Changes in the mechanical properties due to forming and heating corresponding to baking are given in Table 7.

TABLE 6

| Alloy No. | 0.2% Yield Strength (kg/mm²) | Mechanical Properties, Formability of T4 Temper Tensile Strength (kg/mm²) | Elongation (%) | Erichsen Value | Limiting Drawing Ratio | Bending Property (Minimum radius by 180° bending) (mm) | Comprehensive Evaluation of Formability | Leuders Mark |
|---|---|---|---|---|---|---|---|---|
| 3 | 10.8 | 21.2 | 31 | 9.9 | 2.19 | 0.5 | 0 | none |

TABLE 7

| Before Forming | | After Forming 5% | | After Forming 10% | | 200°C. × 1 Hr 0% | |
|---|---|---|---|---|---|---|---|
| $\sigma_B$ (kg/mm²) | $\sigma_{0.2}$ (kg/mm²) | $\sigma_B$ (kg/mm²) | $\sigma_{0.2}$ (kg/mm²) | $\sigma_B$ (kg/mm²) | $\sigma_{0.2}$ (kg/mm²) | $\sigma_B$ (kg/mm²) | $\sigma_{0.2}$ (kg/mm²) |
| 21.2 | 10.8 | 21.5 | 15.8 | 22.3 | 19.6 | 23.1 | 14.1 |

| Before Forming | | 200° C. × 1 Hr 5% | | 200° C. × 1 Hr 10% | | Comprehensive Evaluation of Mechanical Properties |
|---|---|---|---|---|---|---|
| $\sigma_B$ (kg/mm²) | $\sigma_{0.2}$ (kg/mm²) | $\sigma_B$ (kg/mm²) | $\sigma_{0.2}$ (kg/mm²) | $\sigma_B$ (kg/mm²) | $\sigma_{0.2}$ (kg/mm²) | |
| 21.2 | 10.8 | 22.3 | 19.2 | 23.0 | 22.2 | x |

In the present example, the starting temperature of the hot-rolling (420° C.) is less than 90% of the lower limit of the solution heat temperature (500° C.), i.e., 450° C. In this case, the solution is not completed within 180 seconds. Therefore the strength after paint paking is not sufficient for automobile application.

EXAMPLE 4

The alloy No. 1 of Table 1 was subjected to the steps of: DC casting; homogenizing and heating for hot-rolling at 530° C. for 2 hours; immediately hot-rolling (finishing temperature, 280° C., thickness 6 mm); dividing the rolled product into halves; cold-rolling one half to 1 mm thickness, and cold-rolling the other half, to 4 mm, intermediate annealing at 320° C. for 2 hours and then cold-rolling to 1 mm; solution heat treatment and quenching of coils using the continuous solution heat treatment furnace (heating at a speed of 1200° C./min, holding at 540° C. for 30 seconds, and cooling at a speed of 1200° C./min); normal-temperature aging for 7 days.

The mechanical properties and formability are given in Table 8.

TABLE 8

| Intermediate Annealing | 0.2% Yield Strength (kg/mm²) | Tensile Strength (kg/mm²) | Elongation (%) | Erichsen Value | Limiting Drawing Ratio | Bending Property (Minimum radius by 180° bending) (mm) | Leuders Mark | Flow Line | Comprehensive Evaluation of Formability |
|---|---|---|---|---|---|---|---|---|---|
| No | 13.2 | 24.0 | 32 | 9.7 | 2.21 | 0.3 | no | yes | yes |
| Yes | 13.0 | 23.8 | 32 | 10.1 | 2.21 | 0.2 | no | no | no |

When intermediate annealing was applied, the flow lines of formed articles were apparently improved. And it is noticeable that the formability index, for example, Erichsen value and minimum bend radius, was also improved by introducing the intermediate annealing. Here, the strength after paint baking was almost at the same level in the two processes mentioned above.

EXAMPLE 5

The aluminum alloy having the composition as shown in Table 9 was subjected to the steps of: DC casting for producing an ingot 400 mm×1000 mm×3000 mm; homogenizing at 530° C. for 10 hours; hot-rolling to a thickness of 4 mm; cold-rolling to a thickness of 1 mm; and cutting the rolled sheet to obtain a sheet section 1000 mm×2000 mm; solution heat treating at 500° C. for 20 minutes in air, followed by quenching in water; straightening by means of stretching by 0.5% with a stretcher for correcting the deformation distortion generated in the quenching after the solution heat treatment; and, a final heat treatment under the conditions as given in Table 10.

The solution heat treated sheets and finally heat-treated sheets were artificially aged at 160° C. for 18 hours to T6 temper.

The mechanical properties and formability in the several stages are shown in Table 11.

TABLE 9

| Alloy No. | Chemical Composition of Alloys (wt %) | | | | | | | | |
|---|---|---|---|---|---|---|---|---|---|
| | Si | Mg | Cu | Fe | Mn | Cr | Ti | B | Al |
| 1 | 1.34 | 0.22 | 0.70 | 0.16 | 0.17 | 0.03 | 0.02 | 0.0003 | " |

TABLE 10

| Symbol of Condition | Condition of Final Heat Treatment | | | | |
|---|---|---|---|---|---|
| | Designation | Heating Speed (°C./sec) | Temperature (°C.) | Holding Time (sec) | Cooling Speed (°C./sec) |
| A | Inventive | 2 | 200 | 50 | $10^3$ |
| B | Inventive | $8 \times 10^{-3}$ | 100 | 7200 | $1.5 \times 10^{-2}$ |
| C | Comparative | $8 \times 10^{-3}$ | 200 | 50 | $10^3$ |
| D | Comparative | 2 | 100 | 50 | $10^3$ |
| E | Comparative | 20 | 200 | 3600 | $10^3$ |
| F | Comparative | 2 | 200 | 20 | $10^{-2}$ |
| G | Comparative | 20 | 300 | 0 | $10^3$ |

In Table 11, "Before stretching (T4 temper)" indicates a T4 temper (solution heat treated, quenched and room temperature aged for two weeks). "Before stretching (T6 Temper)" indicates the T6 temper, in which the sheet is solution heat treated, quenched, and aged at 160° C. for 18 hours without straightening. "After Stretching" indicates the T4 temper, in which the sheet is solution heat treated, quenched and straightened by stretching and then a lapse of 2 weeks is allowed. "After Final Annealing" indicates the successive treatments of solutioning, quenching, straightening, and final heat treatment as given in Table 10.

TABLE 11

| | Condition | Results | | | | | | |
|---|---|---|---|---|---|---|---|---|
| | | A Inventive | B Inventive | C Comparative | D Comparative | E Comparative | F Comparative | G Comparative |
| Before Stretching (T4 temper) | Tensile Strength (kg/mm²) | 23.1 | 23.1 | 23.1 | 23.1 | 23.1 | 23.1 | 23.1 |
| | 0.2% Yield Strength (kg/mm²) | 11.6 | 11.6 | 11.6 | 11.6 | 11.6 | 11.6 | 11.6 |
| | Elongation (%) | 31 | 31 | 31 | 31 | 31 | 31 | 31 |
| | Erichsen Value | 10.2 | 10.2 | 10.2 | 10.2 | 10.2 | 10.2 | 10.2 |
| | Bending Property (Minimum radius by 180° bending) (mm) | 0.3 | 0.3 | 0.3 | 0.3 | 0.3 | 0.3 | 0.3 |
| Before Stretching (T6 temper) | Tensile Strength (kg/mm²) | 25.1 | 25.1 | 25.1 | 25.1 | 25.1 | 25.1 | 25.1 |
| | 0.2% Yield Strength (kg/mm²) | 16.2 | 16.2 | 16.2 | 16.2 | 16.2 | 16.2 | 16.2 |
| After Stretching | Tensile Strength (kg/mm²) | 24.2 | 24.2 | 24.2 | 24.2 | 24.2 | 24.2 | 24.2 |
| | 0.2% Yield Strength (kg/mm²) | 13.1 | 13.1 | 13.1 | 13.1 | 13.1 | 13.1 | 13.1 |
| | Elongation (%) | 28 | 28 | 28 | 28 | 28 | 28 | 28 |
| | Erichsen Value | 9.3 | 9.3 | 9.3 | 9.3 | 9.3 | 9.3 | 9.3 |
| | Bending Property (Minimum radius by 180° bending) (mm) | 0.7 | 0.7 | 0.7 | 0.7 | 0.7 | 0.7 | 0.7 |
| After | Tensile Strength | 22.8 | 23.3 | 24.1 | 24.2 | 25.1 | 24.0 | 23.1 |

TABLE 11-continued

| | Condition | A Inventive | B Inventive | C Comparative | D Comparative | E Comparative | F Comparative | G Comparative |
|---|---|---|---|---|---|---|---|---|
| | | Results | | | | | | |
| Final Annealing | (kg/mm²) 0.2% Yield Strength (kg/mm²) | 10.9 | 11.8 | 18.3 | 13.0 | 22.1 | 17.9 | 11.3 |
| | Elongation (%) | 31 | 31 | 21 | 28 | 13 | 22 | 30 |
| | Erichsen Value | 10.2 | 10.2 | 6.2 | 9.3 | 5.1 | 6.3 | 10.1 |
| | Bending Property (Minimum radius by 180° bending) (mm) | 0.3 | 0.3 | 1.2 | 1.2 | 1.2 | 1.0 | 0.3 |
| After Final Heat Treatment (T6 temper) | Tensile Strength (kg/mm²) | 24.3 | 25.1 | — | — | — | — | 25.2 |
| | 0.2% Yield Strength (kg/mm²) | 15.8 | 16.1 | — | — | — | — | 16.2 |
| Distortion of Final Sheet | | o | o | o | o | o | o | x |

"After Final Heat Treatment (T6 Temper)" indicates the successive treatments of "After Final Annealing" and then aging (160° C.×18 hrs).

As is apparent from Table 11, in any of the listed conditions, the elongation and Erichsen value are low in the state of after stretching, compared with the state of a T4 temper before stretching. The formability therefore is reduced by the stretching. However, in the conditions A and B according to a preferred embodiment of the present invention, the elongation and Erichsen value after final annealing are virtually equal to those of the T4 temper prior to stretching. It is therefore apparent that the formability is completely restored by the final heat treatment. Also, in the conditions A and B according to the preferred embodiments, the enhancement in strength due to the T6 treatment after the final heat treatment is virtually equal to that due to the T6 treatment after the solution treatment and before the stretching. Note, the final heat treatment under conditions A and B did not result in a distortion such that the flatness of a stretched sheet was impaired.

In the comparative Condition C, the heating speed was so slow that the formability was more seriously reduced than that after stretching. Also, in the comparative Condition D, the holding time at the temperature was too short. In this case, the formability was restored slightly, but could not reach that of the T4 temper before stretching. Further, in Condition E, the cooling speed was so slow that the formability was reduced by the final heat treatment. In Condition F, the cooling speed was so fast that the formability was restored but the flatness was impaired due to the additional distorting by quenching.

We claim:

1. A process for producing an aluminum-alloy rolled sheet for forming, comprising the steps of:

forming an alloy ingot of an aluminum alloy which consists essentially of, in % by weight, from 0.4 to 2.5% of Si, Mg and Cu in an amount depending on the Si content as follows:

(a) in the case of $0.4\% \leqq Si \leqq 1.0\%$, $0.1\% \leqq Mg < 0.4\%$ and $0.3\% < Cu \leqq 1.5\%$;

(b) in the case of $1.0\% < Si \leqq 1.8\%$, $0.1\% \leqq Mg < 0.25\%$ and $0.3\% < Cu < 1.5\%$; and (c) in the case of $1.8\% < Si \leqq 2.5\%$, $0.1\% \leqq Mg < 0.25\%$ and $0\% \leqq Cu \leqq 1.5\%$, and from 0.05 to 0.4% Fe, the balance being aluminum and unavoidable impurities;

homogenizing the alloy ingot at a temperature of from 450° to 580° C. for a period of from 1 to 48 hours;

subsequently, hot-rolling optionally followed by cold-rolling until a requisite sheet thickness is obtained;

solution heat treating by holding the rolled sheet at a temperature of from 500° to 580° C. for a period of at least 5 seconds, followed by rapid cooling; and aging at room temperature.

2. A process according to claim 1, wherein the hot rolling is started at a temperature of at least 90% of the temperature of the solution heat treatment and finished at a temperature of not more than 350° C.

3. A process according to claim 2, wherein in the solution treatment step, the heating speed up to the solutioning temperature is not less than 5° C./second, and the holding time at the solutioning temperature is not less than 5 seconds, and the cooling speed from the solutioning temperature is not less than 5° C./second.

4. A process according to claim 1, further comprising: between the hot-rolling step and the solution heat treatment step, an intermediate annealing step at a temperature of from 300° to 450° C. for a holding time of from 0.5 to 10 hours; and, between the intermediate annealing and the solution treatment, a step of cold-rolling at a reduction of not less than 30%.

5. A process according to claim 4, wherein the temperature of the intermediate annealing is from 300° to 350° C.

6. A process according to claim 1, further comprising a step of subjecting the quenched rolled sheet in the form of a coil or a cut section to straightening for flattening distortion generated by the quenching.

7. A process according to claim 6, further comprising a step of heat treating the straightened sheet, wherein heating to a temperature of from 60° to 360° C. is carried out at a speed falling within the hatched region in appended FIG. 1, the temperature is held for a time falling within the hatched region in appended FIG. 2, and then cooling is carried out at a speed falling within the hatched region of FIG. 1.

8. A process according to claim 1, 2, 3, 4, 5, 6, or 7, wherein said aluminum alloy further contains at least one member selected from the group consisting of from 0.05 to 0.6% of Mn, from 0.05 to 0.3% of Cr, and from 0.05 to 0.15% of Zr.

9. A process according to claim 2, wherein in the solution heat treatment step, the heating speed up to the solutioning temperature is not less than 5° C./sec, and the holding time at the solutioning temperature is not less than 5 seconds, and the cooling speed from the solutioning temperature is not less than 5° C./second.

10. A process according to claim 2, further comprising:

between the hot-rolling step and the solution heat treatment step, an intermediate annealing step at a temperature of from 300° to 450° C. for a holding time of from 0.5 to 10 hours; and, between the intermediate annealing and the solution treatment, a step of cold-rolling at a reduction of not less than 30%.

11. A process according to claim 10, wherein the temperature of the intermediate annealing is from 300° to 350° C.

12. A process according to claim 2, further comprising a step of subjecting the quenched rolled sheet in the form of a coil or a cut section to straightening for flattening distortion generated by the quenching.

13. A process according to claim 12, further comprising a step of heat treating the straightened sheet, wherein heating to a temperature of from 60° to 360° C. is carried out at a speed falling within the hatched region in appended FIG. 1, the temperature is held for a time falling within the hatched region in appended FIG. 2, and, then cooling is carried out at a speed falling within the hatched region of FIG. 1.

14. A process according to claim 9, 10, 11, 12, or 13 wherein said aluminum alloy further contains at least one member selected from the group consisting of from 0.05 to 0.6% of Mn, from 0.05 to 0.3% of Cr, and from 0.05 to 0.15% of Zr.

15. A process according to claim 3, further comprising: between the hot-rolling step and the solution treatment step, an intermediate annealing step at a temperature of from 300° to 350° C. for a holding time of from 0.5 to 10 hours; and, between the intermediate annealing and the solution treatment, a step of cold-rolling at a reduction of not less than 30%.

16. A process according to claim 3, further comprising a step of subjecting the quenched rolled sheet in the form of a coil or a cut section to straightening for flattening distortion generated by the quenching.

17. A process according to claim 16, further comprising a step of heat treating the straightened sheet, wherein heating to a temperature of from 60° to 360° C. is carried out at a speed falling within the hatched region in appended FIG. 1, the temperature is held for a time falling within the hatched region is appended FIG. 2, and, then cooling is carried out at a speed falling within the hatched region of FIG. 1.

18. A process according to claim 16, or 17, wherein said aluminum alloy further contains at least one member selected from the group consisting of from 0.05 to 0.6% of Mn, from 0.05 to 0.3% of Cr, and from 0.05 to 0.15% of Zr.

19. A process according to claim 4, further comprising a step of subjecting the quenched rolled sheet in the form of a coil or a cut section to straightening for flattening distortion generated by the quenching.

20. A process according to claim 19, further comprising a step of heat treating the straightened sheet, wherein heating to a temperature of from 60° to 360° C. is carried out at a speed falling within the hatched region in appended FIG. 1, the temperature is held for a time falling within the hatched region in appended FIG. 2, and, then cooling is carried out at a speed falling within the hatched region of FIG. 1.

21. A process according to claim 19 or 20, wherein said aluminum alloy further contains at least one member selected from the group consisting of from 0.05 to 0.6% of Mn, from 0.05 to 0.3% of Cr, and from 0.05 to 0.15% of Zr.

* * * * *